US005885129A

United States Patent [19]

Norris

[11] Patent Number: 5,885,129

[45] Date of Patent: Mar. 23, 1999

[54] DIRECTABLE SOUND AND LIGHT TOY

[75] Inventor: Elwood G. Norris, Poway, Calif.

[73] Assignee: American Technology Corporation, Poway, Calif.

[21] Appl. No.: 826,395

[22] Filed: Mar. 25, 1997

[51] Int. Cl.[6] ..... A63H 5/04; A63H 33/30

[52] U.S. Cl. ..... 446/405; 446/473

[58] Field of Search ..... 446/405, 404, 446/406, 407, 397, 473, 484, 485; 381/190

[56] References Cited

U.S. PATENT DOCUMENTS

| | | | |
|---|---|---|---|
| 1,616,639 | 2/1927 | Sprague . | |
| 1,951,669 | 3/1934 | Ramsey . | |
| 2,461,344 | 2/1949 | Olson . | |
| 3,012,222 | 12/1961 | Hagemann . | |
| 3,220,732 | 11/1965 | Pincus | 446/405 X |
| 3,398,810 | 8/1968 | Clark, III . | |
| 3,461,421 | 8/1969 | Stover . | |
| 3,612,211 | 10/1971 | Clark, III . | |
| 3,613,069 | 10/1971 | Cary et al. . | |
| 3,710,332 | 1/1973 | Tischner et al. . | |
| 3,723,957 | 3/1973 | Damon . | |
| 3,742,433 | 6/1973 | Kay et al. . | |
| 3,836,951 | 9/1974 | Geren et al. . | |
| 4,171,811 | 10/1979 | Meyer et al. | 446/405 X |
| 4,175,353 | 11/1979 | Pickett | 446/406 |
| 4,207,571 | 6/1980 | Passey . | |
| 4,245,136 | 1/1981 | Krauel, Jr. . | |
| 4,365,439 | 12/1982 | Litynski | 446/406 |
| 4,378,596 | 3/1983 | Clark . | |
| 4,593,160 | 6/1986 | Nakamura . | |
| 4,823,908 | 4/1989 | Tanaka et al. . | |
| 4,991,148 | 2/1991 | Gilchrist . | |
| 5,125,866 | 6/1992 | Arad et al. | 446/397 |
| 5,259,807 | 11/1993 | Crow | 446/406 X |
| 5,314,543 | 5/1994 | Grosch . | |
| 5,346,418 | 9/1994 | Arad | 446/405 X |
| 5,357,578 | 10/1994 | Tanishi . | |
| 5,484,316 | 1/1996 | Poirier | 446/404 X |
| 5,539,705 | 7/1996 | Akerman et al. | 367/132 |
| 5,630,744 | 5/1997 | Bandy | 446/405 X |

OTHER PUBLICATIONS

Ultrasonic Ranging System—Polaroid.

Helmholtz (Excerpts from On Combination Tones)—Editor's Comments on Paper 16.

Aoki, K. et al., "Parametric Loudspeaker—Characteristics of Acoustic Field and Suitable Modulation of Carrier Ultrasound," Electronics and Communications in Japan, Part 3, vol. 74, No. 9, pp. 76–82 (1991).

Makarov, S.N., et al., "Parametric Acoustic Nondirectional Radiator," *Acustica,* vol. 77 (1992).

Westervelt, P.J., "Parametric Acoustic Array," *The Journal of the Acoustical Society of America,* vol. 35, No. 4, pp.—(1963).

*Primary Examiner*—Kien T. Nguyen
*Assistant Examiner*—D. Neal Muir
*Attorney, Agent, or Firm*—Thorpe, North & Western, LLP

[57] ABSTRACT

A toy device for simulating a weapon which comprises a toy body having a configuration which supplies a directional orientation for aiming the toy body at a target and a parametric speaker. The parametric speaker generates at least one new sonic frequency from at least two ultrasonic frequencies of different value, and projects them directionally toward the targeted area. The speaker comprises i) an ultrasonic frequency generator; ii) a sonic frequency generator; iii) modulating means coupled to the ultrasonic frequency generator and the sonic frequency generator for producing the at least two ultrasonic frequencies of different value; and iv) at least one ultrasonic frequency emitter coupled to the modulating means and aligned for transmission with the directional orientation of the toy body for propagating the at least two ultrasonic frequencies and concurrently generating the new sonic frequency with directional sound transmission orientation toward the target. A firing mechanism is coupled to the toy body for activating the parametric speaker to generate the new sonic frequency. A light source may also be attached to the toy weapon for providing visual targeting where the parametric speaker and light source are in common target alignment.

31 Claims, 2 Drawing Sheets

DIRECTABLE SOUND AND LIGHT TOY

BACKGROUND OF THE INVENTION

1. Field of the Invention

This invention pertains to toy weapons which provide sound as a complement to simulate reality. More particularly, the present invention relates to a device and method for enhancing toy weapons with realistic sound directionally projected from a parametric speaker.

2. State of the Art

Toy weapons have been popular with children for many years. Enhancements for such toys have included the addition of sound to create a sense of reality. For example, the use of caps as part of a rifle or pistol gave a child an opportunity to operate the toy with the realism of sound, timed with pulling the trigger. The emergence of space-type toy weapons has extended conventional explosive sounds to hums, buzzes, swishes, and an unending array of other strange noises suggesting space combat experience. Such sounds are now pre-recorded and played back from the toy weapon through a conventional speaker usually contained within the toy.

Although these enhanced devices provide enjoyment to the user, a significant drawback arises because of their limited projection range. Typically, the intent of the manufacturer is merely to localize sound for the user to react. It is not anticipated that the sound is to project to other playmates. For example, in a typical shoot-out, the other child may be 100 feet or more away and will not likely hear the bang or buzz associated with his friends toy gun. Accordingly, the supposed victim of the shoot-out will question the alleged "hit" because he has no appreciation for accuracy or timing.

Efforts to extend this element of mutual recognition between playmates has prompted the use of paint balls and other forms of projectile which confirm the "hit", supposedly without risk of injury. These contact devices do, in fact, create potential harm based on impact at the eyes. Therefore, cautious parents and friends usually discourage unsupervised use of such toys. Furthermore, impact on other objects such as walls, furniture and vehicles can cause damage. Accordingly, proliferation of a general toy weapon which operates with a clear framework of safety has not occurred.

OBJECTS AND SUMMARY OF THE INVENTION

It is an object of the present invention to provide a toy weapon which provides directional sound as a means of confirming accurate engagement.

It is a further object of this invention to enhance the realism of toy weapon use by combining simulated weapon fire sound which is audible to the targeted player.

It is yet another object of the present invention to integrate confirmation of accurate hit, with realism of sound for the targeted player.

A still further object of this invention is to provide localized sound at the toy for the benefit of the user, in combination with projected sound which is localized at the target.

Another object of the present invention is to supplement target identification with a projected light from the toy weapon, enabling the user to visually confirm when his targeted companion has been accurately engaged.

It is an additional object of this invention to enable voice communication between the user and distant targeted player by means of the projected sound from the toy weapon.

These and other objects are realized in a toy device for simulating a weapon which comprises a toy body having a configuration which supplies a directional orientation for aiming the toy body at a target and wherein the toy body includes a parametric speaker. The parametric speaker generates at least one new sonic frequency from at least two ultrasonic frequencies of different value, and projects them directionally toward the targeted area. The speaker comprises i) an ultrasonic frequency generator; ii) a sonic frequency generator; iii) modulating means coupled to the ultrasonic frequency generator and the sonic frequency generator for producing the at least two ultrasonic frequencies of different value; and iv) at least one ultrasonic frequency emitter coupled to the modulating means and aligned for transmission with the directional orientation of the toy body for propagating the at least two ultrasonic frequencies and concurrently generating the new sonic frequency with directional sound transmission orientation toward the target. A firing mechanism is coupled to the toy body for activating the parametric speaker to generate the new sonic frequency. A light source may also be attached to the toy weapon for providing visual targeting where the parametric speaker and light source are in common target alignment.

Other objects, features and benefits will be apparent to those skilled in the art, based on the following detailed description, in combination with the accompanying drawings.

DETAILED DESCRIPTION OF THE PREFERRED EMBODIMENT

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the appended claims.

Figure 1:
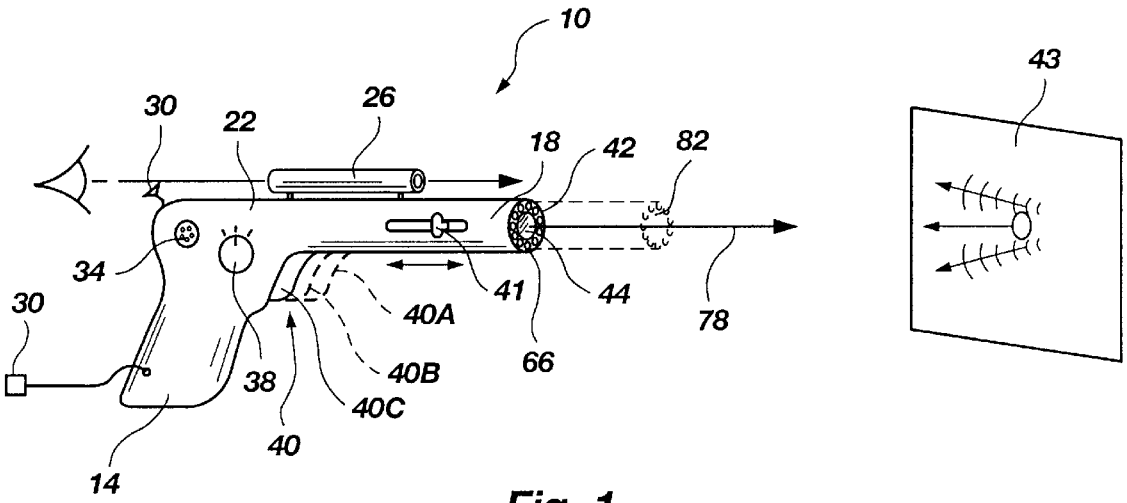
FIG. 1 illustrates one embodiment of a toy weapon combining the various features of the present invention aligned with a graphic target display.

FIG. 1 illustrates one embodiment of a toy weapon similar to a pistol. It will be apparent that this specific structure is intended to represent many different types of simulated weapons which have been or may be used in child play. The features shown in FIG. 1 could similarly be applied to a rifle, space gun, or any other toy which typically includes a toy body having a configuration which supplies a directional orientation for aiming the toy body at a target.

The preferred embodiment comprises a weapon 10 which includes a handle 14, barrel 18 and primary body 22. The handle 14 can be any structure which enables the user to support the toy in a hand held firing position. It also provides a housing, in combination with the primary body 22, for containment of the operating mechanisms, circuitry and battery power. A sighting device 26 is provided to assist the user in target alignment, as well as provide magnification for detecting the reflection of light on the targeted object.

In addition, the weapon 10 includes a speaker 30, a microphone 34, a selector dial 38, a trigger 40, a focal length adjustor 41, and a parametric speaker 42. In the preferred embodiment, the speaker 30 takes the form of either an ear jack, ultrasonic transducer or a simple audio speaker. The purpose of the speaker is to allow the user of the weapon 10 the ability to hear the sounds that the weapon sends to a target 43. Providing the user with these sounds enhances the enjoyment of using the toy weapon 10. The microphone 34 is actuated by audio signals in its proximity and allows the user to send audio signals to the target 43. Although the user may desire to send vocal signals to the target 43, at times, the user may desire to remain undetectable from the target, thus, the selector dial 38 allows the user to select different functions of the weapon 10. For example, the selector dial 38 could be used to disable the microphone 34 or to select different weapon simulations, e.g., a machine gun, a rifle, space gun, pre-recorded messages or any other suitable toy configuration.

The trigger 40 is shown in both solid and hidden lines to indicate that the trigger has multiple positions, i.e., a rest position 40A, an intermediate position 40B, and an engaged position 40C. In the preferred embodiment, the rest position 40A is used when the toy weapon 10 is not in use. The intermediate position 40B partially engages the weapon 10 by engaging a light source 44 but not the parametric speaker 42. This light source 44 is controlled by the focal length adjustor 41 so that a beam of light may be directed to the target 43. If the selector dial 38 is so positioned, the engaged position 40C of the trigger 40 is used to engage the light source 44 in combination with the parametric speaker 42.

The primary component of the present invention is the parametric speaker 42 which is coupled to the toy body for indirectly generating at least one new sonic frequency from at least two ultrasonic frequencies of different value. The principles and structure enabling generation of this parametric or acoustical heterodyne effect have been set forth in previous applications of the present inventor, including Ser. No. 08/744,114. In addition, the general theory of difference wave generation between two ultrasonic frequencies has been well documented within the prior art. The present inventor has advanced the theory to a level of commercial application with significant improvements which have increased amplitude output and focused directionality.

Figure 2:
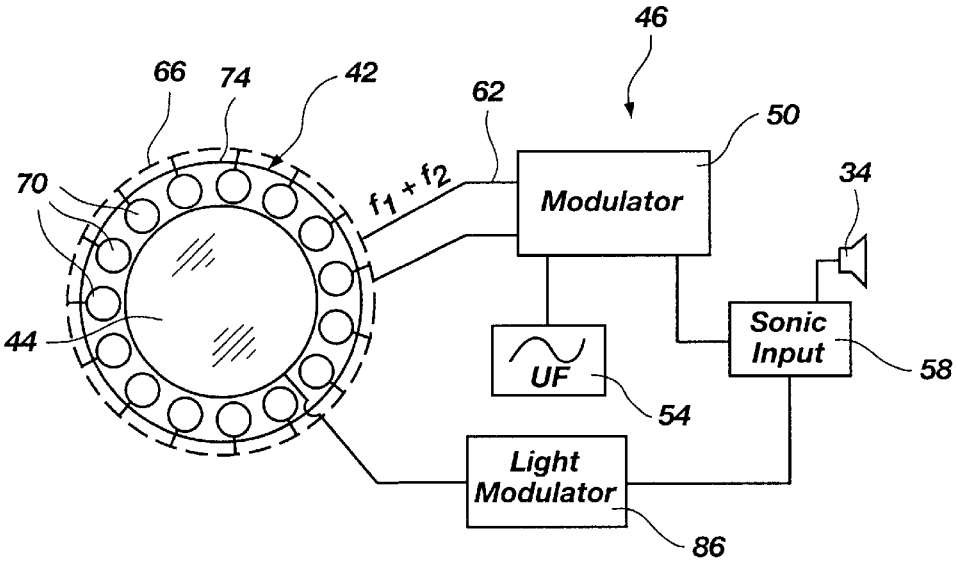
FIG. 2 depicts an emitter end of the toy weapon, with supporting circuitry and power source shown coupled in block diagram.

As illustrated in FIG. 2, the parametric speaker 42 includes a typical circuit 46 in which a modulator 50 is coupled to an ultrasonic frequency generator 54 and a sonic frequency generator 58. Amplitude modulation operates to produce at least two ultrasonic frequencies 62 of different value, such that the modulated output embodies a new sonic signal which is decoupled when emitted within a nonlinear medium such as air. In this case, using either an upper or lower sideband, a new sonic signal is generated in the air, equal to 5 kHz, based on the difference of the base carrier frequency of 50 kHz and 45 khz or 55 kHz sideband signals. This new sonic output is extremely directional in view of the high frequency of the carrier in the ultrasonic range. This enables the user to aim the toy weapon 10 at a distant target 43, engage the parametric speaker 42 and emit the 5 kHz sonic compression wave at the target.

In basic form, the parametric speaker 42 comprises an ultrasonic frequency generator 54 for providing a base or carrier frequency which is identified as f1. This frequency is typically in a range of 40 kHz to 100 kHz, well above the audio range of 20 to 20,000 Hz. Therefore, the base frequency is not detectable to the human user.

Essentially, the ultrasonic base frequency develops audio output by combining in air with a second ultrasonic frequency whose value differs from the base frequency by a frequency range within audio bandwidth. This is accomplished by use of a sonic frequency generator 58 programmed to supply the desired sonic signal. This generator 58 may be a preprogrammed computer chip which includes various bursts, bangs, hums, whistles, sirens, swishes, and buzzes useful to simulate the intended weapon, or an analog source of sound. It could also be sonic signals that are generated at the weapon and detected by the microphone 34. For example, the user could speak into the microphone 34 and have the audio signals entered into the sonic frequency generator 58.

In each instance, the sonic output is fed to the modulator 50 which modulates the sonic signal with the ultrasonic base frequency to produce at least two frequencies, f1 and f2, representing two ultrasonic frequencies. For example, if f1 equals 50 kHz and the sonic signal is 5 kHz, the resulting frequencies include 50 kHz and 55 kHz, comprising the sum of the modulated frequencies. In reality, there may be an additional sideband frequency representing the lower sideband of 45 kHz (the difference between the base and sonic frequencies); however, either or both modulated frequencies will serve the purposes of this disclosure.

FIGS. 1 and 2 identify an ultrasonic emitter component 66 of the parametric speaker 42. This component 66 comprises at least one ultrasonic frequency emitter 70 coupled to the modulator 50 and aligned for transmission with the directional orientation of the toy body 22. The emitter 70 may be any transducer or other means for generating ultrasonic frequencies in accordance with parametric technology. The specific transducers 70 (or emitters) shown in this embodiment comprise a set of four to twelve or more bimorph transducers. The actual number of transducers 70 will depend on the physical dimensions of the barrel 18 or emitter 70 structure.

In the present embodiment, the transducers 70 are positioned around a barrel opening 74 of the toy weapon 10 to form a parametric array. It has been discovered that a ring of transducers 70 is surprisingly effective in generating a highly directional, high amplitude, narrow beam of sonic output. Indeed, the absence of transducers within the ring appears to have little effect on the actual output of the parametric array. The sound pressure level (SPL) attenuation as a function of distance is virtually the same for a ring of transducers, as for a continuous array of transducers disposed across the full surface of the barrel 18 end. This discovery enables successful implementation of the present invention because the ring of transducers 70 is ideal for a circumferential configuration around a barrel or other weapon body. It also enables adaptation of the weapon with other features such as the fixation of the light source 44 within the barrel opening 74 or smoke simulation or a soft projectile of some sort from the barrel 18 to further enhance realism of the firing mode of the toy weapon 10.

The use of a directional light beam 78 in combination with directional sound 82 creates many benefits previously unknown within the toy industry. For example, a focused beam of light provides a silent scanning device for target identification. The user simply activates the light source 44 and moves the toy weapon 10 and sighting device (or mechanism) 26 until the desired target 43 is illuminated with a spot of light. This silent mode of target detection enhances the excitement of game activities because it allows for the element of surprise. The user knows he has accurate target engagement because the light 78 and sound beams 82 are in substantial alignment. Therefore, the user is able to confirm accurate engagement based on the illuminated spot on the target 43, and the opposing player confirms a valid "hit" based on the audible sound of the weapon 10.

Many forms of light source 44 are well suited for this duality aspect of sound and light. For example, the directional light source 44 may be a laser 44, a light emitting diode, a flash tube with parabolic reflector, or any other form of directional light source which can provide a narrow light beam 78. The adjustable focusing device 41 may also be added to provide depth adjustment for the focal point of the beam.

A further entertaining feature of the dual sound and light aspect of the present invention occurs when the light source 44 includes a light modulator 86 for modulating transmission of the light source 44 with sonic input from the parametric speaker 42. A conventional modulation circuit coupled between the parametric speaker 42 and the voltage source for the light enables the light intensity to vary with variations in the sonic output. For example, light intensity may track amplitude of the sonic output, and thereby provide a visual component to the firing of the weapon. If the toy weapon simulated a machine gun, the pre-recorded sound heard at the target location would correspond to rapid bursts of machine gun fire. At the same time, the light source 44 which is modulated with the sonic output would give a visual impression of fire bursts from the barrel 18. During darkness, this combination of effects creates exciting realism for the participants.

Other interesting effects are developed when the light modulator 86 responds to differing amplitude or frequency values of the sonic input 58. For example, either light intensity or color could be correlated with sound concurrently emitted from the toy weapon to create an array of exotic space toys. These would include pointer toys and weapons which appear to cast sound and light at a wall or other reflective surface to create eerie environments. The combinations of changing colors and intensities with varying space-like sounds—all appearing to emanate from the wall or reflective surface creates a mysterious and entertaining environment. Such modulating means can be coupled with speech to create an impression of a talking light.

As indicated above, the device may include an integrated computer chip having prerecorded sonic signals which simulate the sound of the weapon. This chip may supply a plurality of different prerecorded sonic signals, and includes a selector dial or switch 38 for preselecting one of the prerecorded signals for transmission from the parametric speaker 42. The prerecorded signal may be selected from many forms of sonic signal, including a human voice, a voice of an animal, an explosive discharge, a buzzing sound, a whistling sound, a humming sound and a periodic sound repeated in rapid sequence. A microphone 34 mounted on the toy could be coupled to the sound generating circuitry for enabling the recording of additional sounds such as the user's voice.

The trigger mechanism or other firing means 40 is coupled to the toy body for activating the parametric speaker 42 to generate the new sonic frequency. In this embodiment, the three-position trigger enables the use of the rest position 40A for when the weapon 10 is not in use, the activation of the light source 44 at the intermediate position 40B, and the engaged position 40C available for subsequently activating the parametric speaker 42. This sequence facilitates visual identification of the target based on a spot of light with the intermediate trigger position 40B. The engaged trigger position 40C can then be selected, giving the sonic signal which puts an opposing player on notice of an accurate "hit".

Figure 3:
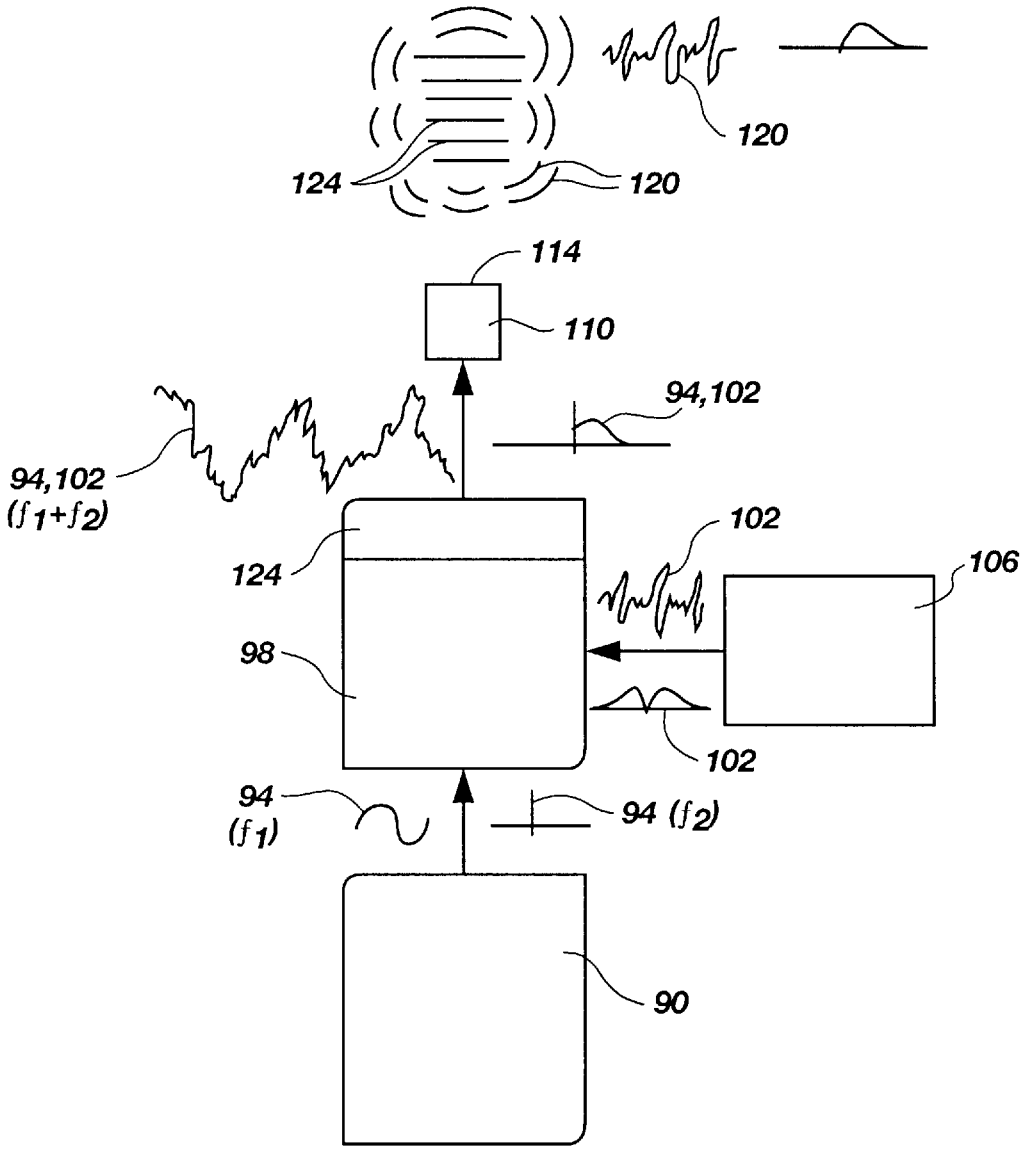
FIG. 3 is a specific implementation of the present invention which transmits an ultrasonic base frequency and an ultrasonic intelligence carrying frequency which acoustically heterodyne to generate a new sonic or subsonic frequency.

FIG. 3 illustrates a basic system which includes an oscillator or digital ultrasonic wave source 90 for providing a base or carrier wave 94. This wave 94 is generally referred to as a first ultrasonic wave or primary wave. An amplitude modulating component 98 is coupled to the output of the ultrasonic wave source (or generator) 90 and receives the base frequency or carrier wave 94 for mixing with a sonic or subsonic input signal 102. The sonic or subsonic signal 102 may be supplied in either analog or digital form, and could be sound from any conventional signal source 106. If the input signal 102 includes upper and lower sidebands, a filter component may be included in the modulator to yield a single sideband output on the modulated carrier frequency for selected bandwidths.

The emitter drum transducer is shown as item 110, which is caused to emit the ultrasonic frequencies $f_1$ and $f_2$ as a new wave form propagated at the face of a thin film transducer 114. This new wave form interacts within the nonlinear medium of air to generate the difference frequency 120, as a new sonic or subsonic wave. The ability to have large quantities of emitter elements formed in an emitter disk is particularly well suited for generation of a uniform wave front which can propagate quality audio output and meaningful volumes.

The present invention is able to function as described because the compression waves corresponding to $f_1$ and $f_2$ interfere in air according to the principles of acoustical heterodyning. Acoustical heterodyning is somewhat of a mechanical counterpart to the electrical heterodyning effect which takes place in a non-linear circuit. For example, amplitude modulation in an electrical circuit is a heterodyning process. The heterodyne process itself is simply the creation of two new waves. The new waves are the sum and the difference of two fundamental waves.

In acoustical heterodyning, the new waves equaling the sum and difference of the fundamental waves are observed to occur when at least two ultrasonic compression waves interact or interfere in air. The preferred transmission medium of the present invention is air because it is a highly compressible medium that responds non-linearly under different conditions. This non-linearity of air enables the heterodyning process to take place, decoupling the difference signal from the ultrasonic output. However, it should be remembered that any compressible fluid can function as the transmission medium if desired.

Whereas successful generation of a parametric difference wave in the prior art appears to have had only nominal volume, the present configuration generates full sound. While a single transducer carrying the AM modulated base frequency was able to project sound at considerable distances and impressive volume levels, the combination of a plurality of co-linear signals significantly increased the volume. When directed at a wall or other reflective surface, the volume was so substantial and directional that it reflected as if the wall were the very source of the sound generation.

An important feature of the present invention is that the base frequency and single or double sidebands are propagated from the same transducer face. Therefore the component waves are perfectly collimated. Furthermore, phase alignment is at maximum, providing the highest level of interference possible between two different ultrasonic frequencies. With maximum interference insured between these waves, one achieves the greatest energy transfer to the air molecules, which effectively become the "speaker" radiating element in a parametric speaker. Accordingly, the inventor believes the enhancement of these factors within a thin film, ultrasonic emitter array as provided in the present invention has developed a surprising increase in volume to the audio output signal.

These various structural components enable practice of a novel method for supplying directional sound from parametric array within a toy weapon or pointer by indirectly generating at least one new sonic frequency which is a difference of at least two interacting ultrasonic frequencies. The basic method comprises the steps of a) emitting from the toy weapon at least one first ultrasonic frequency along a direction which is in alignment with a directional orientation of the toy weapon; b) emitting from the toy weapon a second ultrasonic frequency in a manner which causes the second ultrasonic frequency to interact with the first ultrasonic frequency to generate the new sonic frequency, wherein the second ultrasonic frequency has a frequency equal to the at least one first ultrasonic frequency plus at least one sideband corresponding to the at least one new sonic frequency; and c) directing the toy weapon at a target and operating the toy weapon to propagate from the target the at least one new sonic frequency.

The new sonic frequency that is generated as a sonic output corresponds to simulated sound from the toy weapon. The simulated sound generated by the new sonic frequency can be speech of a user of the toy weapon that is electronically amplified. The toy weapon has circuitry for modulating the speech as part of the second ultrasonic frequency to thereby transmit the speech to the target in a directionally isolated manner. Of course, this new sonic frequency can be recorded on a memory chip and transmitted from the memory chip as part of the second ultrasonic frequency.

Another aspect of the method described above is the step of emitting a directional light from the toy weapon along the directional orientation of the weapon to identify the target visually, thus, the target may be isolated for transmitting the new sonic frequency thereto. The directional light emitted from the toy weapon may then be modulated with the new sonic frequency. When modulated, the light emitted from the toy weapon creates a variable light transmission which correlates with the sonic input.

The method can also include the step of transmitting a predetermined voice message to a designated target in an isolated manner so that the message is heard only in direct proximity to the target. The selector dial 38 has a setting that allows the weapon 10 to be used in this manner.

In another embodiment, the toy weapon is described as a pointing device having a directional orientation for identifying a distant object by audio detection by indirectly propagating from the distant object at least one new sonic frequency as a by-product of emitting at least two ultrasonic frequencies from an ultrasonic frequency emitter. The pointing device includes (a) an ultrasonic frequency signal source for providing a first ultrasonic frequency signal; (b) a supply mechanism for supplying an electrical signal corresponding to the at least one new sonic frequency wave train; (c) a modulating mechanism coupled to the ultrasonic frequency signal generator and supply mechanism for combining the first ultrasonic frequency signal with the electrical signal corresponding to the at least one new sonic frequency to thereby generate a second ultrasonic frequency signal; (d) an ultrasonic frequency emitter which is coupled to an output of the modulating mechanism for (i) propagating both the first and second ultrasonic frequency signals, and (ii) generating the at least one new sonic frequency wave train as a by-product of interference between the first and second ultrasonic frequency signals; and (e) a light source having a directional means for focusing light toward an object, said light source and ultrasonic frequency emitter having common directional alignment.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A toy device for simulating a weapon or communicator, said device comprising:

a handheld toy body having a configuration which supplies a directional orientation for aiming the toy body at a target;

parametric speaker means coupled to the toy body for indirectly generating at least one new sonic frequency from at least two ultrasonic frequencies of different value, said speaker means comprising:

i) an ultrasonic frequency generator;

ii) a sonic frequency generator;

iii) modulating means coupled to the ultrasonic frequency generator and the sonic frequency generator for producing the at least two ultrasonic frequencies of different value;

iv) at least one ultrasonic frequency emitter coupled to the modulating means and aligned for transmission with the directional orientation of the toy body for propagating the at least two ultrasonic frequencies and concurrently generating the new sonic frequency based on interaction between the at least two ultrasonic frequencies within a nonlinear medium of air with a directional sound transmission orientation toward the target;

firing means coupled to the toy body for activating the parametric speaker means to generate the new sonic frequency.

2. The device as defined in claim 1 wherein the modulating means comprises an amplitude modulating device which modulates an ultrasonic frequency signal with a sonic signal to thereby generate the at least two ultrasonic frequencies, said modulating means including means for generating the at least one new sonic frequency in a form which simulates a sound of the weapon.

3. The device as defined in claim 2 wherein the modulating means includes means for generating a single sideband signal embodying the at least two ultrasonic frequencies for optimizing amplitude and transmission of a sonic frequency of predetermined bandwidth.

4. The device as defined in claim 2, wherein the sonic frequency generator includes an integrated computer chip having prerecorded sonic signals which simulate the sound of the weapon.

5. The device as defined in claim 4, further comprising means for supplying a plurality of different prerecorded sonic signals, and including selector means for preselecting one of the prerecorded signals for transmission from the parametric speaker.

6. The device as defined in claim 4, wherein the prerecorded signal is selected from the group consisting of a human voice, a voice of an animal, an explosive discharge, a buzzing sound, a whistling sound, a humming sound and a periodic sound repeated in rapid sequence.

7. The device as defined in claim 1, further comprising means for recording additional sounds to a signal storage means coupled to the sonic frequency generator.

8. The device as defined in claim 1, further comprising a directional light source positioned to emit light along the directional orientation of the device to enable visual target identification.

9. The device as defined in claim 8, wherein the directional light source comprises a laser.

10. The device as defined in claim 8, wherein the directional light source comprises a light emitting diode.

11. The device as defined in claim 8, wherein the directional light source comprises a flash tube.

12. The device as defined in claim 8, further comprising light modulating means for modulating transmission of the light source with sonic input from the parametric speaker.

13. The device as defined in claim 12, wherein the light modulating means responds to differing frequency values of the sonic input to emit correlated light and sound concurrently from the toy weapon.

14. The device as defined in claim 12, wherein the light modulating means includes means for correlating sonic input comprising speech with output of the light source, thereby creating an impression of a talking light.

15. The device as defined in claim 14, further comprising microphone means coupled to the sonic frequency generator for enabling direct transmission of a sonic frequency comprising a human voice to the target.

16. The device as defined in claim 8, further comprising focusing means operable with respect to the light source for increasing light intensity at a desired distance and location.

17. The device as defined in claim 1 wherein the toy body comprises a simulated weapon selected from the group consisting of pistols, rifles, laser weapons, and guns.

18. The device as defined in claim 1 wherein the at least one ultrasonic frequency emitter is comprised of an ultrasonic acoustical transducer.

19. The device as defined in claim 1, further comprising a microphone and associated audio amplification circuitry coupled to the toy body for detecting sound, said audio amplification circuitry being coupled to the modulating means for providing the detected sound as a new sonic frequency to enable transmission of speech as the new sonic frequency.

20. The device as defined in claim 1 wherein the device further comprises an ultrasonic frequency signal generator which transmits the first ultrasonic frequency to the modulating means and wherein the modulating means includes input means for mixing at least one new sonic frequency with the first ultrasonic frequency as upper and lower sidebands for transmitting low frequencies within an audio range.

21. The device as defined in claim 1 wherein the device further comprises a speaker means for transmitting sonic signals at the device wherein the sonic signals that propagate toward the target are also emitted in the vicinity of the device.

22. The device as defined in claim 21 wherein the speaker means comprises an ear phone for a user to place in his ears for hearing the sonic signals which propagate toward the target.

23. A toy as defined in claim 1, wherein the at least one ultrasonic frequency emitter comprises an ultrasonic emitter ring for emitting the at least two ultrasonic signals.

24. A toy as defined in claim 23, wherein the emitter ring comprises a ring of transducers capable of emitting within an ultrasonic frequency range.

25. A toy as defined in claim 23, wherein the emitter ring is positioned around a barrel opening of the toy weapon 10 to form a parametric speaker array.

26. A toy as defined in claim 23, wherein the emitter ring generates a highly directional, high amplitude, narrow beam of sonic output.

27. A toy as defined in claim 24, wherein the emitter ring forms a circumferential configuration around the barrel opening.

28. A toy as defined in claim 24, further comprising a light source within the barrel opening.

29. A toy as defined in claim 24, further comprising a smoke simulation source within the barrel opening.

30. A toy as defined in claim 24, further comprising a soft projectile within the barrel opening to further enhance realism of firing of the toy weapon.

31. A pointing device having a directional orientation for identifying a distant object by audio detection by indirectly propagating from the distant object at least one new sonic frequency as a by-product of emitting at least two ultrasonic frequencies from an ultrasonic frequency emitter, said device comprised of:

an ultrasonic frequency signal source for providing a first ultrasonic frequency signal;

supply means for supplying an electrical signal corresponding to the at least one new sonic frequency wave train;

modulating means coupled to the ultrasonic frequency signal generator and supply means for combining the first ultrasonic frequency signal with the electrical signal corresponding to the at least one new sonic frequency to thereby generate a second ultrasonic frequency signal;

an ultrasonic frequency emitter which is coupled to an output of the modulating means for (i) propagating both the first and second ultrasonic frequency signals, and (ii) generating the at least one new sonic frequency wave train as a by-product of interference between the first and second ultrasonic frequency signals; and a light source having a directional means for focusing light toward an object, said light source and ultrasonic frequency emitter having common directional alignment.

* * * * *